US010236105B2

(12) United States Patent
Zhang et al.

(10) Patent No.: US 10,236,105 B2
(45) Date of Patent: Mar. 19, 2019

(54) HIGH MAGNETIC INDUCTION ORIENTED SILICON STEEL AND MANUFACTURING METHOD THEREOF

(71) Applicant: BAOSHAN IRON & STEEL CO., LTD., Shanghai (CN)

(72) Inventors: Huabing Zhang, Shanghai (CN); Guobao Li, Shanghai (CN); Xijiang Lu, Shanghai (CN); Yongjie Yang, Shanghai (CN); Zhuochao Hu, Shanghai (CN); Kanyi Shen, Shanghai (CN); Jiaqiang Gao, Shanghai (CN); Meihong Wu, Shanghai (CN)

(73) Assignee: BAOSHAN IRON & STEEL CO., LTD, Shanghai (CN)

( * ) Notice: Subject to any disclaimer, the term of this patent is extended or adjusted under 35 U.S.C. 154(b) by 153 days.

(21) Appl. No.: 14/422,991

(22) PCT Filed: Dec. 11, 2012

(86) PCT No.: PCT/CN2012/001683
§ 371 (c)(1),
(2) Date: Feb. 20, 2015

(87) PCT Pub. No.: WO2014/032216
PCT Pub. Date: Mar. 6, 2014

(65) Prior Publication Data

US 2015/0206633 A1 Jul. 23, 2015

(30) Foreign Application Priority Data

Aug. 30, 2012 (CN) ..... 2012 1 0315658

(51) Int. Cl.
*C21D 6/00* (2006.01)
*C23C 8/26* (2006.01)
(Continued)

(52) U.S. Cl.
CPC ..... *H01F 1/14783* (2013.01); *C21D 6/002* (2013.01); *C21D 6/005* (2013.01);
(Continued)

(58) Field of Classification Search
None
See application file for complete search history.

(56) References Cited

U.S. PATENT DOCUMENTS 6,039,818 A * 3/2000 Toge ..... C21D 8/1233 148/307
8,778,095 B2 * 7/2014 Iwanaga ..... C21D 8/1255 148/208
(Continued)

FOREIGN PATENT DOCUMENTS

CN 102453838 A 5/2012
CN 102471818 A 5/2012
(Continued)

OTHER PUBLICATIONS

Machine translation of JP11-043746. Feb. 1999.*
Machine translation of JP02-294428A, Dec. 1990.*

*Primary Examiner* — Xiaowei Su
(74) *Attorney, Agent, or Firm* — Eversheds-Sutherland (US) LLP

(57) ABSTRACT

The invention relates to high magnetic induction oriented silicon steel and a preparation method thereof. The oriented silicon steel comprises the following chemical elements by weight percent: 0.035-0.120% of C, 2.9-4.5% of Si, 0.05-0.20% of Mn, 0.005-0.050% of P, 0.005-0.012% of S, 0.015-0.035% of Als, 0.001-0.010% of N, 0.05-0.30% of Cr, 0.005-0.090% of Sn, not more than 0.0100% of V, not more than 0.0100% of Ti, at least one of trace elements of Sb, Bi, Nb and Mo, and the balance of Fe and other inevitable impurities, wherein Sb+Bi+Nb+Mo is 0.0015-0.0250% and
(Continued)

(Sb/121.8+Bi/209.0+Nb/92.9+Mo/95.9)/(Ti/47.9+V/50.9) ranges from 0.1 to 15.

6 Claims, 1 Drawing Sheet

(51) Int. Cl.

| | |
|---|---|
| ***H01F 1/147*** | (2006.01) |
| ***C21D 8/12*** | (2006.01) |
| ***C22C 38/34*** | (2006.01) |
| ***C22C 38/00*** | (2006.01) |
| ***C22C 38/04*** | (2006.01) |
| ***C22C 38/06*** | (2006.01) |
| ***C22C 38/24*** | (2006.01) |
| ***C22C 38/28*** | (2006.01) |
| ***H01F 1/18*** | (2006.01) |
| ***C23F 17/00*** | (2006.01) |
| ***C22C 38/22*** | (2006.01) |
| ***C22C 38/26*** | (2006.01) |
| ***C22C 38/60*** | (2006.01) |

(52) U.S. Cl.

CPC ..... *C21D 6/008* (2013.01); *C21D 8/12* (2013.01); *C21D 8/1222* (2013.01); *C21D 8/1233* (2013.01); *C21D 8/1255* (2013.01); *C22C 38/001* (2013.01); *C22C 38/002* (2013.01); *C22C 38/008* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/34* (2013.01); *C22C 38/60* (2013.01); *C23C 8/26* (2013.01); *C23F 17/00* (2013.01); *H01F 1/18* (2013.01)

(56) References Cited

U.S. PATENT DOCUMENTS

| | | | | |
|---|---|---|---|---|
| 2003/0034092 | A1 * | 2/2003 | Takashima | C21D 8/1255 148/111 |
| 2013/0206283 | A1 * | 8/2013 | Inoue | C21D 1/38 148/108 |

FOREIGN PATENT DOCUMENTS

| | | | | |
|---|---|---|---|---|
| CN | 102471819 | A | 5/2012 | |
| CN | 102787276 | A | 11/2012 | |
| JP | 02294428 | A * | 12/1990 | |
| JP | 11043746 | A | 2/1999 | |
| WO | WO 2011148849 | A1 * | 12/2011 | C21D 8/1255 |
| WO | WO 2012017693 | A1 * | 2/2012 | C21D 1/38 |

* cited by examiner

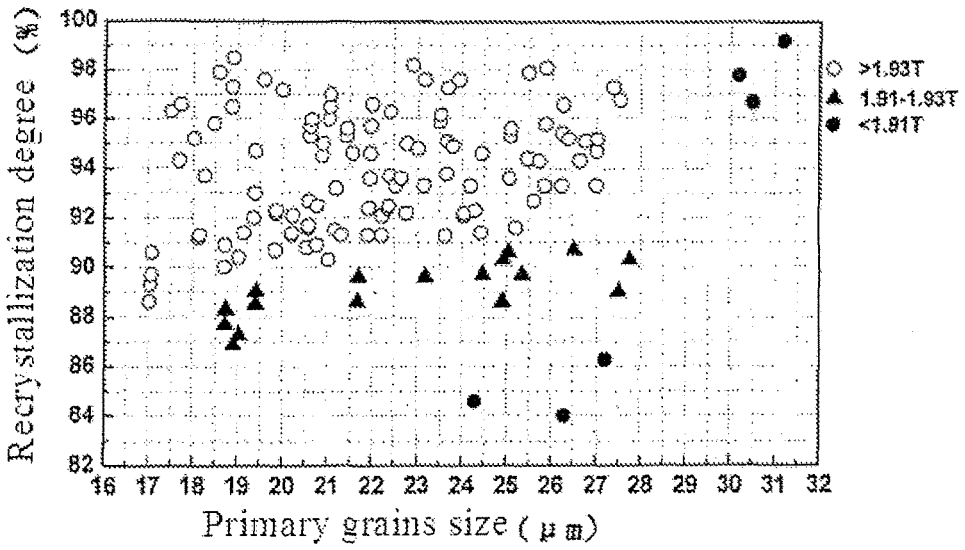
Recrystallization degree (%)
100
98
96
94
92
90
88
86
84
82
16 17 18 19 20 21 22 23 24 25 26 27 28 29 30 31 32
Primary grains size (μm)
>1.93T
1.91-1.93T
<1.91T

HIGH MAGNETIC INDUCTION ORIENTED SILICON STEEL AND MANUFACTURING METHOD THEREOF

CROSS-REFERENCE TO RELATED APPLICATIONS

This application claims priority to and benefit of PCT Application No. PCT/CN2012/001683, entitled "High Magnetic Induction Oriented Silicon Steel and Manufacturing Method Thereof," filed Dec. 11, 2012, which claims the benefit of Chinese Patent Application No, 201210315658.2 filed on Aug. 30, 2012, which are both incorporated herein by reference in their entirety.

FIELD OF THE INVENTION

The invention relates to a steel plate and a manufacturing method thereof, in particular to a silicon steel and a manufacturing method thereof.

BACKGROUND OF THE INVENTION

A traditional high magnetic induction oriented silicon steel comprises the following basic chemical components: 2.0-4.5% of Si, 0.03-0.10% of C, 0.03-0.2% of Mn, 0.005-0.050% of S, 0.02-0.05% of Als (acid-soluble aluminum) and 0.003-0.012% of N, and some component systems further contain one or more of Cu, Mo, Sb, B, Bi and other elements.

A traditional manufacturing method of the traditional high magnetic induction oriented silicon steel comprises the following steps: firstly performing steel making by a converter (or an electric furnace), performing secondary refining and alloying, and performing continuous casting to form a slab; then heating the slab to about 1400° C. in a special high-temperature heating furnace and performing heat preservation for 45 min or more, in order to be conductive to full solid solution of favorable inclusions; then performing hot rolling and laminar cooling, then coiling, precipitating small and dispersed second phase particles in a silicon steel base body in a normalizing process of a hot-rolled plate to obtain effective inhibitors; further performing cold rolling on the hot-rolled plate to the thickness of a finished product, then decarbonizing and annealing to remove C in a steel plate to the degree in which the magnetic performance of the finished product is not affected (which should be 30 ppm or less generally), and coating an annealing isolation agent taking MgO as a main component; further performing high-temperature annealing to realize secondary recrystallization of the steel plate in a high-temperature annealing process, forming a magnesium silicate bottom layer and completing purification treatment (for removing S, N and other elements in steel which are harmful to magnetic property) to obtain the high magnetic induction oriented silicon steel with high degree of orientation and low iron loss; and finally coating an insulating coating, stretching and annealing to obtain an oriented silicon steel product in a commercial application form.

The traditional manufacturing method of the high magnetic induction oriented silicon steel has the following deficiencies: in order to realize full solid solution of the inhibitors, the highest heating temperature needs to reach 1400° C., which is the limit level of the traditional heating furnace. In addition, due to high heating temperature and great burning loss, the heating furnace needs to be repaired frequently and the utilization rate is low. Simultaneously, due to high energy consumption and large edge cracks of a hot-rolled coil, in the cold-rolling procedure, it is difficult to produce, the yield is low and the cost is high.

In view of the above mentioned problems, a large number of studies about reducing the heating temperature of the oriented silicon steel have been developed in the technical field. By differentiating according to the range of heating temperature of the slab, there are two main improvement paths, one is a medium-temperature slab heating process, in which the heating temperature of the slab is 1250-1320° C. and AlN and Cu are taken as the inhibitors; and the other one is a low-temperature slab heating process, in which the heating temperature of the slab is 1100-1250° C., and the inhibitors are introduced by adopting a nitriding method.

At present, the development of the low-temperature slab heating process is faster, for example, the heating of the slab is performed at a temperature of 1200° C. or less, final cold rolling is performed at a cold rolling reduction ratio of more than 80%, and ammonia gas is adopted in the decarbonizing and annealing process to perform continuous nitriding treatment and perform high-temperature annealing to obtain secondary recrystalized grains with relatively high degree of orientation. The manufacturing process has the advantages that the high magnetic induction oriented silicon steel (HiB) can be produced with relatively low cost and the typical magnetic induction $B_8$ of the silicon steel is 1.88-1.92 T.

The inhibitors of the low-temperature slab heating process are mainly from the small and dispersed (Al, Si), N, (Mn, Si) and N particles which are formed by combination of nitrogen and original aluminum in the steel through the nitriding treatment after decarbonizing and annealing. Simultaneously, the inhibitors are also from the existing inclusions in the slab, these inclusions are formed in the steel-making and casting process, realize partial solid solution in the heating process of the slab and are precipitated in the rolling process, and the form of the inclusions can be adjusted by normalizing and annealing, thereby having important influence on primary recrystallization and further affecting the magnetic performance of the final product. When the size of the primary grains is matched with the level of inhibition, the secondary recrystallization is perfected, and the magnetic performance of the final product is excellent. In the normalizing process, although the nitride inhibitors are affected by the form of the inclusions in the slab, it is quite difficult to control the form of the inclusions in the slab, for example, the coarse AlN formed in the casting process is difficult to realize solid solution in the subsequent annealing, thereby causing great difficulty in control of stability of the size of the primary grains and low probability of stably obtaining the high-grade HiB product with the magnetic induction $B_8$ of not less than 1.93 T. In addition, under the condition that the thickness of the finished product is determined, some measures for further reducing the iron loss generally will reduce the magnetic induction, for example, by increasing the Si content or performing laser scribing or the like. The range of applications of these methods for reducing the iron loss is limited due to the reduction in magnetic induction. Other methods for improving the magnetic induction $B_8$, such as fast heating in the decarbonizing and annealing process, need to additionally add special devices such as fast induction heating device or ohmic heating device and the like, and thus the investment cost is increased. In addition, fast heating will increase defects in the bottom layer of the finished product, in particular to the occurrence rate of bright point-like defects.

Chinese patent document with patent publication number of CN1138107A, publication date of Dec. 18, 1996, entitled "High-magnetic flux density and low-iron loss grain oriented electromagnetic steel plate and manufacturing method thereof" discloses an electromagnetic steel plate, which contains 2.5-4.0 wt % of Si and 0.005-0.06 wt % of Al; in all grains of the steel plate, calculated by area rate, at least 95% of the grains are constituted by coarse secondary recrystalized grains with the diameter of 5-50 mm, the (001) axis has an angle of within 5° relative to the rolling direction of the steel plate and the (001) axis has the angle of within 5° relative to the vertical direction of the plate surface; and in the coarse secondary recrystalized grains or a grain boundary, there exist the small grains with the diameter of 0.05-2 mm, and the relative angle of the (001) axis of small grains to the (001) axis of the coarse secondary grains is 2-30°.

Japanese patent document with patent publication number of JP8232020A, publication date of Sep. 10, 1996, entitled "Manufacturing method of directional electromagnetic steel sheet" relates to a manufacturing method for producing a silicon steel sheet with low price and excellent magnetic property, and the manufacturing method includes the steps of performing cold continuous rolling at a specific rolling speed and annealing, regulating to the total nitrogen content at specific ppm and then completing annealing. The steel sheet comprises the following components in weight percent: 0.001-0.09% of C, 2-4.5% of silicon, 0.01-0.08% of acid-soluble aluminum, 0.0001-0.004% of N, 0.008-0.06% of independent or total S and (or) selenium; 0.01-1% of copper, 0.01-0.5% of manganese, a small quantity of Bi, P, Sn, Pb, B, V, niobium and the like and the balance of Fe and other inevitable impurities. The cold continuous rolling ratio of the cold-rolled silicon steel is 75-95%, the annealing temperature is 800-1000° C., the annealing time is 1300 s, and the total nitrogen content is 50-1000 ppm.

Japanese patent document with patent publication number of JP4337029A, publication date of Nov. 25, 1992, entitled "One-time recrystallization sintering method of directional electromagnetic steel plate" discloses a manufacturing method of a directional electromagnetic steel plate, and the manufacturing method mainly relates to a control method of size of primary grains of nitriding of oriented silicon steel, and proposes a method for adjusting decarbonizing temperature according to Als, N and Si.

SUMMARY OF THE INVENTION

The object of the present invention is to provide high magnetic induction oriented silicon steel and a manufacturing method thereof. On the premise of not additionally adding devices, by designing steel components and controlling a decarbonizing and annealing process, an oriented silicon steel product with more excellent magnetic performance is obtained, and the magnetic induction thereof is obviously improved in comparison with the ordinary oriented silicon steel and the typical magnetic induction $B_8$ thereof is more than 1.93 T.

In order to realize the object of the present invention, the present invention provides high magnetic induction oriented silicon steel, which comprises the following chemical elements by weight percent: 0.035-0.120% of C, 2.9-4.5% of Si, 0.05-0.20% of Mn, 0.005-0.050% of P, 0.005-0.012% of S, 0.015-0.035% of Als, 0.001-0.010% of N, 0.05-0.30% of Cr, 0.005-0.090% of Sn, not more than 0.0100% of V, not more than 0.0100% of Ti, at least one of trace elements Sb, Bi, Nb and Mo, and the balance of Fe and other inevitable impurities, wherein Sb+Bi+Nb+Mo is 0.0015-0.0250% and (Sb/121.8+Bi/209.0+Nb/92.9+Mo/95.9)/(Ti/47.9+V/50.9) value, namely the mole fraction ratio of (Sb+Bi+Nb+Mo)/(V+Ti) ranges from 0.1 to 15.

Furthermore, the high magnetic induction oriented silicon steel of the present invention has the primary grains size Φ which is not more than 30 μm, and the primary recrystallization degree P which is not less than 90%.

In the technical solution, by adding the trace element Sb, Bi, Nb or Mo and controlling the content of impurity elements V and Ti, carbon compounds and nitrogen compounds of the trace elements are preferably formed, and the quantity of MnS+AlN composite inclusions taking TiN, TiC or VN as the core in a slab is greatly reduced. As the size of these composite inclusions is coarse, the full solid solution can not be realized in a heating and subsequent annealing process of the slab and the inhibition effect is poor. With the increases in the content sum of (Sb+Bi+Nb+Mo) and the mole fraction rate of (Sb+Bi+Nb+Mo)/(V+Ti), on the one hand, the trace element and their formed carbon compounds and nitrogen compounds can be used as auxiliary inhibitors to play a role in strengthening inhibition, and on the other hand, as the amount of the MnS+AlN composite inclusions is reduced and the amount of the small and dispersed AlN is increased, not only the level of inhibition for secondary recrystallization is strengthened, but also the situation is also favorable for obtaining small and uniform primary grains and high primary recrystallization degree and perfecting secondary recrystallization, and the magnetic induction of a finished steel plate is thus obviously improved.

Correspondingly, the present invention further provides a manufacturing method of the high magnetic induction oriented silicon steel, comprising the following steps:

(1) smelting and casting to obtain a slab;
(2) hot-rolling;
(3) normalizing and annealing;
(4) cold-rolling;
(5) decarbonizing and annealing: the decarbonizing temperature meets the formula $T(x_1, x_2)=ax_1+bx_2+c$, wherein $x_1$ is the content by weight percent of Sb+Bi+Nb+Mo and the unit thereof is ppm, $x_2$ is the mole fraction ratio of (Sb+Bi+Nb+Mo)/(V+Ti), the unit thereof is 1, a ranges from 0.1 to 1.0, b ranges from 0.1 to 1.0 and c ranges from 800 to 900° C., and represents the decarbonizing temperature when the trace element is not added; and the decarbonizing time is 80-160 s;
(6) performing nitriding treatment;
(7) coating MgO on a steel plate and then performing high-temperature annealing; and
(8) coating an insulating coating and performing hot stretching, leveling and annealing to obtain the high magnetic induction oriented silicon steel.

Furthermore, in the manufacturing method of the high magnetic induction oriented silicon steel of the present invention, the decarbonizing and annealing temperature is controlled to enable the primary grains size Φ to be not more than 30 μm and enable the primary recrystallization degree P to be not less than 90%.

Furthermore, the manufacturing method of the high magnetic induction oriented silicon steel of the present invention further comprises step (9) of refining a magnetic domain to obtain a product with relatively low required iron loss. Refining the magnetic domain can adopt a laser scribing method, and after laser scribing, the magnetic performance of the high magnetic induction oriented silicon steel is more excellent.

Furthermore, in step (2) of the manufacturing method of the high magnetic induction oriented silicon steel according to the present invention, the heating temperature is not more than 1250° C.

Furthermore, in step (4) of the manufacturing method of the high magnetic induction oriented silicon steel according to the present invention, the cold rolling reduction ratio is not less than 75%.

Furthermore, in step (6) of the manufacturing method of the high magnetic induction oriented silicon steel according to the present invention, the content of infiltrated nitrogen is 50-260 ppm.

It is key point for the manufacturing method of the high magnetic induction oriented silicon steel according to the present invention to control the decarbonizing temperature. The setting of the appropriate decarbonizing temperature needs to realize two purposes: one purpose is to enable the primary grains size Φ to be not more than 30 μm, and the other purpose is to enable the recrystallization degree P of primary recrystallization to be not less than 90%, wherein the primary recrystallization degree P is defined as the proportion of primary recrystallization of a steel strip after decarbonizing and annealing. When the primary grains size Φ is not more than 30 μm and the recrystallization degree P is not less than 90%, the magnetic performance of the steel strip is more excellent. In order to enable both the primary grains size and the recrystallization degree to meet the above required ranges, the decarbonizing temperature needs to be set according to the content and the proportion of the trace element in the slab, and meet a function relation formula $T(x_1, x_2)=ax_1+bx_2+c$. In the technical solution, the primary grains size Φ and the primary recrystallization degree P can be measured by adopting conventional measurement means in the art, for example, the primary recrystallization degree P can be measured by adopting electron backscattered diffraction (EBSD).

In addition, it can be seen from the function relation formula of the decarbonizing temperature that the decarbonizing temperature after adding the trace element Sb, Bi, Nb or Mo is higher than that without adding these element component systems. This is because the amount of MnS+AlN composite inclusions in the steel plate is reduced and the amount of small and dispersed AlN is increased, the inhibition effect for primary recrystallization is strengthened and the decarbonizing temperature thus needs to be increased appropriately.

Compared with the ordinary high magnetic induction oriented silicon steel, the high magnetic induction oriented silicon steel according to the present invention has higher primary recrystallization degree, smaller and more uniform the primary grains size, and coarser secondary recrystalized grains, and thus the magnetic induction thereof is significantly improved and the magnetic performance of the product is stable while the iron loss is not reduced or is slightly reduced.

In the manufacturing method of the high magnetic induction oriented silicon steel according to the present invention, by adding the trace element in the steel-making process, controlling the content of corresponding impurity elements in combination with the adjustment of the subsequent decarbonizing and annealing process, the primary grains size is not more than 30 μm and the recrystallization degree of primary recrystallization is not less than 90%, the trace element and their formed carbon compounds and nitrogen compounds can be used as the auxiliary inhibitors, the amount of the MnS+AlN composite inclusions in the slab is reduced, and the amount of the small and dispersed AlN is increased, thereby being favorable for obtaining small and uniform primary grains and high primary recrystallization degree, improving the magnetic induction of the finished product, and further obtaining the oriented silicon steel with the excellent magnetic performance.

BRIEF DESCRIPTION OF THE DRAWING

FIG. 1 shows a relation of the primary grains size, the recrystallization degree and magnetic induction of high magnetic induction oriented silicon steel.

DETAILED DESCRIPTION OF THE EMBODIMENTS

FIG. 1 shows a relation of the primary grains size, the recrystallization degree and magnetic induction of high magnetic induction oriented silicon steel in the technical solution. It can be seen from FIG. 1 that for the technical solution, when the primary grains size Φ is not more than 30 μm and the primary recrystallization degree P is not less than 90%, the magnetic induction $B_8$ of a steel strip is more than 1.93 T.

The technical solution of the present invention is further described and explained below in conjunction with specific embodiments and comparative examples.

The high magnetic induction oriented silicon steel of the present invention is manufactured according to the following steps:

(1) smelting according to component formulation as shown in Table 1 and casting to obtain a slab;

(2) heating the slab at the temperature of 1150° C. and then hot-rolling to obtain a hot-rolled plate with the thickness of 2.3 mm;

(3) normalizing and annealing;

(4) cold-rolling to obtain a finished product with the thickness of 0.30 mm;

(5) decarbonizing to reduce the content of C in a steel plate to 30 ppm or less under the conditions that the decarbonizing temperature meets a function relation formula $T=0.21x_1+0.16x_2+831$ and the decarbonizing time is 80-160 s;

(6) performing nitriding treatment, wherein the content of infiltrated N is 100-160 ppm;

(7) coating MgO on the steel plate and then performing high-temperature annealing for 20 h under the conditions that the atmosphere is 100% $H_2$ and the temperature is 1200° C.; and (8) uncoiling, then coating an insulating coating and performing hot stretching, leveling and annealing to obtain the high magnetic induction oriented silicon steel. The above decarbonizing temperature function relation formula is determined by the following steps: performing test combinations of different components and different decarbonizing temperatures on the steel which is cold-rolled to the thickness of the finished product and subjects to high-temperature annealing for 25 h, measuring the primary grains size Φ and the primary recrystallization degree P of each decarbonized steel plate, selecting steel coils having a primary grains size of not more than 30 μm and the primary recrystallization degree P of not less than 90% for statistical analysis (when the values of $x_1$ and $x_2$ are the same, preferably, the steel coils with larger P/Φ values are used for statistical analysis), and using a linear fitting method to obtain a, b and c in the function relation formula of the decarbonizing temperature to $x_1$ and $x_2$. Data participating in fitting are as shown in Table 2.

TABLE 1

| Serial Number | C (wt %) | Si (wt %) | Mn (wt %) | P (wt %) | S (wt %) | Als (wt %) | N (wt %) | Cr (wt %) | Sn (wt %) | V (wt %) | Ti (wt %) | Content sum of (Sb + Bi + Nb + Mo) (wt %) | Mole fraction ratio of (Sb + Bi + Nb + Mo)/(Ti + V) |
|---|---|---|---|---|---|---|---|---|---|---|---|---|---|
| 1 | 0.053 | 3.3 | 0.12 | 0.015 | 0.011 | 0.027 | 0.006 | 0.10 | 0.045 | 0.0010 | 0.0010 | 0.0020 | 0.63 |
| 2 | 0.064 | 3.2 | 0.16 | 0.015 | 0.01 | 0.025 | 0.008 | 0.20 | 0.025 | 0.0006 | 0.0008 | 0.0025 | 0.92 |
| 3 | 0.042 | 2.9 | 0.07 | 0.045 | 0.008 | 0.024 | 0.005 | 0.20 | 0.025 | 0.0014 | 0.0021 | 0.0050 | 0.71 |
| 4 | 0.070 | 3.2 | 0.11 | 0.030 | 0.006 | 0.034 | 0.008 | 0.20 | 0.025 | 0.0015 | 0.0024 | 0.0060 | 0.63 |
| 5 | 0.064 | 3.1 | 0.09 | 0.035 | 0.006 | 0.030 | 0.006 | 0.15 | 0.008 | 0.0008 | 0.0013 | 0.0075 | 1.42 |
| 6 | 0.076 | 3.4 | 0.19 | 0.015 | 0.007 | 0.031 | 0.006 | 0.15 | 0.013 | 0.0018 | 0.0028 | 0.0109 | 0.93 |
| 7 | 0.083 | 3.5 | 0.09 | 0.010 | 0.006 | 0.025 | 0.009 | 0.10 | 0.046 | 0.0004 | 0.0005 | 0.0133 | 5.72 |
| 8 | 0.045 | 3.3 | 0.08 | 0.020 | 0.009 | 0.026 | 0.005 | 0.10 | 0.067 | 0.0007 | 0.0012 | 0.0176 | 3.43 |
| 9 | 0.054 | 3.3 | 0.12 | 0.020 | 0.011 | 0.028 | 0.006 | 0.10 | 0.080 | 0.0016 | 0.0025 | 0.0223 | 1.99 |
| 10 | 0.037 | 3.2 | 0.06 | 0.020 | 0.005 | 0.029 | 0.006 | 0.20 | 0.025 | 0.0009 | 0.0012 | 0.0211 | 3.67 |
| 11 | 0.054 | 3.2 | 0.08 | 0.015 | 0.006 | 0.024 | 0.005 | 0.08 | 0.046 | 0.0003 | 0.0004 | 0.0245 | 12.12 |
| 12 | 0.047 | 3.1 | 0.17 | 0.020 | 0.006 | 0.024 | 0.005 | 0.08 | 0.046 | 0.0011 | 0.0012 | 0.0014 | 0.29 |
| 13 | 0.053 | 3.2 | 0.08 | 0.015 | 0.006 | 0.030 | 0.006 | 0.25 | 0.025 | 0.0052 | 0.0079 | 0.0017 | 0.06 |
| 14 | 0.094 | 3.1 | 0.08 | 0.020 | 0.006 | 0.031 | 0.006 | 0.15 | 0.090 | 0.0220 | 0.0331 | 0.0110 | 0.09 |
| 15 | 0.055 | 3.0 | 0.10 | 0.010 | 0.007 | 0.025 | 0.005 | 0.08 | 0.044 | 0.0049 | 0.0090 | 0.0252 | 0.80 |
| 16 | 0.058 | 3.2 | 0.06 | 0.025 | 0.007 | 0.033 | 0.008 | 0.15 | 0.034 | 0.0010 | 0.0013 | 0.0303 | 6.28 |
| 17 | 0.057 | 3.3 | 0.10 | 0.015 | 0.009 | 0.033 | 0.008 | 0.20 | 0.025 | 0.0008 | 0.0013 | 0.0623 | 13.46 |

(Serial numbers 1-11 are examples and serial numbers 12-17 are comparative examples)

TABLE 2

| Serial Number | Content sum of (Sb + Bi + Nb + Mo) (ppm) | Mole ratio of (Sb + Bi + Nb + Mo)/(V + Ti) | Decarbonizing temperature (° C.) | primary grains Size (μm) | Primary recrystallization degree (%) | p/Φ value *100 | Data selection |
|---|---|---|---|---|---|---|---|
| 1 | 30 | 0.5 | 837 | ○ | ○ | | ✓ |
| 2 | 30 | 2.4 | 838 | ○ | ○ | | ✓ |
| 3 | 60 | 1.8 | 844 | ○ | ○ | 5.28 | ✓ |
| 4. | 60 | 2.3 | 843 | ○ | ○ | 4.26 | ✓ |
| 5 | 70 | 1.8 | 846 | ○ | ○ | | ✓ |
| 6 | 80 | 8.2 | 849 | ○ | ○ | | ✓ |
| 7 | 30 | 0.5 | 825 | x | x | | |
| 8 | 30 | 2.4 | 848 | x | ○ | | |
| 9 | 60 | 1.8 | 845 | ○ | ○ | 3.54 | |
| 10 | 60 | 2.3 | 845 | ○ | ○ | 3.77 | |
| 11 | 70 | 1.8 | 853 | x | ○ | | |
| 12 | 80 | 8.2 | 842 | x | x | | |
| 19 | 30 | 0.5 | 830 | ○ | x | | |
| 20 | 30 | 2.4 | 832 | ○ | x | | |
| 21 | 60 | 1.8 | 838 | ○ | x | | |
| 22 | 60 | 2.3 | 838 | ○ | x | | |
| 23 | 70 | 1.8 | 838 | ○ | x | | |
| 24 | 80 | 8.2 | 843 | ○ | x | | |

Note:
○ means that the requirements are met; and x means that the requirements are not met.

Table 3 shows the decarbonizing temperature, the recrystallization degree, the primary grains size of, the magnetic induction $B_8$ and the iron loss $P_{17/50}$ of examples 1-12 and comparative examples 14-17.

TABLE 3

| Serial Number | Decarbonizing temperature (° C.) | Recrystallization degree (%) | Pimary grains Size (μm) | $B_8$ (T) | $P_{17/50}$ (W/kg) |
|---|---|---|---|---|---|
| 1 | 835 | 90.6 | 25.2 | 1.942 | 0.991 |
| 2 | 835 | 92.8 | 24.1 | 1.948 | 0.982 |
| 3 | 840 | 97.9 | 22.5 | 1.953 | 0.970 |
| 4 | 845 | 99.5 | 21.7 | 1.959 | 0.964 |
| 5 | 845 | 98.6 | 20.8 | 1.941 | 0.961 |
| 6 | 855 | 97.6 | 23.7 | 1.936 | 0.956 |
| 7 | 860 | 92.2 | 20.6 | 1.951 | 0.993 |
| 8 | 870 | 99.3 | 22.1 | 1.952 | 0.972 |
| 9 | 880 | 97.9 | 21.5 | 1.943 | 0.974 |

TABLE 3-continued

| Serial Number | Decarbonizing temperature (° C.) | Recrystallization degree (%) | Pimary grains Size (μm) | $B_8$ (T) | $P_{17/50}$ (W/kg) |
|---|---|---|---|---|---|
| 10 | 875 | 98.5 | 19.7 | 1.949 | 0.984 |
| 11 | 885 | 94.6 | 20.8 | 1.937 | 0.981 |
| 12 | 835 | 87.3 | 26.2 | 1.913 | 0.996 |
| 13 | 835 | 88.1 | 25.8 | 1.917 | 0.969 |
| 14 | 855 | 83.4 | 23.9 | 1.909 | 1.035 |
| 15 | 885 | 86.7 | 23.7 | 1.923 | 1.001 |
| 16 | 895 | 83.4 | 18.7 | 1.892 | 1.103 |
| 17 | 965 | 79.3 | 16.9 | 1.729 | 1.356 |

It can be seen from Table 1 and Table 3 that, the steel coil which adopts the technical solution of the present invention and particularly meets the component design requirements of the present invention in the content and the proportion of the trace element, and meets the requirements in the decarbonizing temperature, the primary grains size and the recrystallization degree generally has great magnetic performance and the magnetic induction $B_8$ thereof is more than 1.93 T.

In order to further describe the influence of the step of refining the magnetic domain on the iron loss performance of the oriented silicon steel, the inventor also adds Sb, Bi, Nb or Mo element according to the components of the conventional low-temperature oriented silicon steel, controls the content of V and Ti to be less than 0.0020%, adopts the appropriate decarbonizing temperatures to obtain the oriented silicon steel products with the thickness of 0.23 mm, and performs laser scribing treatment to obtain a plurality of products. The magnetic performance of each product is shown in Table 4.

TABLE 4

| Serial Number | Content sum of (Sb + Bi + Nb + Mo) (ppm) | Grains Size of finished product (mm) | $B_8$ before scribing (T) | $P_{17/50}$ before scribing (W/kg) | $B_8$ after scribing (T) | $P_{17/50}$ after scribing (W/kg) | Iron loss improvement rate (%) |
|---|---|---|---|---|---|---|---|
| 1 | 23 | 196 | 1.952 | 0.885 | 1.946 | 0.725 | 18.10% |
| 2 | 31 | 229 | 1.958 | 0.909 | 1.94 | 0.761 | 16.30% |
| 3 | 45 | 138 | 1.949 | 0.89 | 1.936 | 0.756 | 15.10% |
| 4 | 75 | 336 | 1.953 | 0.903 | 1.951 | 0.777 | 14.00% |
| 5 | 126 | 423 | 1.958 | 0.91 | 1.944 | 0.737 | 19.00% |
| 6 | 152 | 238 | 1.954 | 0.893 | 1.943 | 0.759 | 15.00% |
| 7 | 186 | 234 | 1.951 | 0.898 | 1.941 | 0.781 | 13.00% |
| 8 | 2 | 30 | 1.912 | 0.879 | 1.895 | 0.809 | 8.0% |
| 9 | 3 | 29 | 1.919 | 0.913 | 1.905 | 0.822 | 10.0% |
| 10 | 5 | 35 | 1.909 | 0.901 | 1.898 | 0.838 | 7.0% |
| 11 | 257 | 41 | 1.912 | 0.913 | 1.899 | 0.867 | 5.0% |

It can be seen from Table 4 that, as the grains of the final products are coarse, the iron loss improvement effects of the products with the serial numbers of 1-7 are very obvious after laser scribing, and the comprehensive magnetic performances of the products after scribing are obviously more excellent than the products with the serial numbers of 8-11.

It should be noted that the examples listed above are only the specific examples of the present invention, and obviously the present invention is not limited to the above examples and can have many similar changes. All variations which can be directly derived from or associated with the disclosure of the invention by those skilled in the art should be within the scope of protection of the present invention.

The invention claimed is:

1. A manufacturing method of a magnetic induction oriented silicon steel, comprising the following operations conducted in sequence:

smelting and casting to obtain a slab;

hot-rolling;

normalizing and annealing;

cold-rolling to obtain a steel plate;

calculating decarbonizing temperature coefficients a and b using a linear fitting method based at least in part on a measurement of a primary grain size Φ and a measurement of a primary recrystallization degree P of a test steel after decarbonizing annealing the test steel;

decarbonizing annealing, wherein the decarbonizing temperature satisfies the formula $T(x_1, x_2)=a\,x_1+bx_2+c$, wherein $x_1$ is the content of Sb+Bi+Nb+Mo with a unit being ppm, $x_2$ is the mole fraction ratio of (Sb+Bi+Nb+Mo)/(V+Ti), a ranges from 0.1to 1.0, b ranges from 0.1 to 1.0 and c ranges from 800 to 900° C.; and the decarbonizing time period is 80-160s;

performing nitriding treatment;

coating the steel plate with MgO and then performing annealing at 1200° C.; and applying an insulating coating and performing hot stretching, flattening annealing so as to obtain the magnetic induction oriented silicon steel;

wherein the magnetic induction oriented silicon steel, comprising the following chemical elements by weight percent:

0.035-0.120% of C, 2.9-4.5% of Si, 0.05-0.20% of Mn, 0.005-0.012% of S, 0.015-0.035% of acid-soluble Al, 0.001-0.010% of N, 0.05-0.30% of Cr, 0.005-0.090% of Sn, not more than 0.0100% of V, not more than 0.0100% of Ti, at least one of trace elements Sb, Bi, Nb and Mo, and the balance being Fe and inevitable impurities;

wherein Sb+Bi+Nb+Mo is 0.0015-0.0250% and the value of (Sb/121.8+Bi/209.0+Nb/92.9+Mo/95.9)/(Ti/47.9+V/50.9) ranges from 0.1 to 15;

wherein the magnetic induction oriented silicon steel has a magnetic induction $B_8$ of more than 1.93T.

2. The manufacturing method of the magnetic induction oriented silicon steel according to claim 1, wherein the decarbonizing temperature is controlled such that Φ is not more than 30 μm and P is not less than 90%.

3. The manufacturing method of the magnetic induction oriented silicon steel according to claim 1, further comprises an operation of refining a magnetic domain.

4. The manufacturing method of the magnetic induction oriented silicon steel according to claim 1, wherein in the operation of hot-rolling, a heating temperature is not more than 1250° C.

5. The manufacturing method of the magnetic induction oriented silicon steel according to claim 1, wherein in the operation of cold-rolling, a cold rolling reduction ratio is not less than 75%.

6. The manufacturing method of the magnetic induction oriented silicon steel according to claim 1, wherein in the operation of performing nitriding treatment, a content of infiltrated nitrogen is 50-260 ppm.

* * * * *